US005544416A

United States Patent [19]

Lin

[11] Patent Number: 5,544,416

[45] Date of Patent: Aug. 13, 1996

[54] SHEARS

[76] Inventor: Mao-Sen Lin, No. 8, Kung Yeh Rd, Chung Ho Tsun, Lung Ching Hsiang, Taichung Hsien, Taiwan

[21] Appl. No.: 407,848

[22] Filed: Mar. 21, 1995

[51] Int. Cl.[6] ..... B26B 17/00

[52] U.S. Cl. ..... 30/193; 30/252

[58] Field of Search ..... 30/191, 192, 193, 30/252, 254, 266, 173, 175, 186, 134

[56] References Cited

U.S. PATENT DOCUMENTS

| | | | |
|---|---|---|---|
| 188,133 | 3/1877 | Hellwig | 30/191 |
| 275,015 | 4/1883 | Blowers | 30/193 |
| 2,579,272 | 12/1951 | Ralston | 30/252 |
| 2,858,609 | 11/1958 | Hill | 30/173 |
| 3,372,478 | 3/1968 | Wallace et al. | 30/193 |
| 4,545,234 | 10/1985 | Schnellmann | 30/193 |

*Primary Examiner*—Scott A. Smith
*Attorney, Agent, or Firm*—Bacon & Thomas

[57] ABSTRACT

A shears including a first blade and a second blade acted against each other, and two pivoted actuating bars turned relative to each other to drive the blades, causing them to make a scissors action for cutting things, wherein the first blade has two projecting portions at one end, a smoothly curved side notch defined between the projecting portions, and a smoothly curved cutting edge at an opposite end along one side; the second blade has a neck portion at one end, a smoothly curved locating head extended from the neck portion and turned in the smoothly curved side notch on the first blade to limit the turning angle of the blades, and an anvil at an opposite end to act against the smoothly curved cutting edge of the first blade.

1 Claim, 6 Drawing Sheets

SHEARS

BACKGROUND OF THE INVENTION

The present invention relates to shears for use in cultivating gardens, and relates more particularly to such a shears which is suitable for cutting big branches as well as small twigs.

FIGS. 1 and 2 show a conventional shears for use in cultivating gardens which is comprised of a cutting unit consisting of a first blade with a cutting edge and a second blade with an anvil, and two pivoted actuating bars turned relative to each other to drive the first and second blades, causing them to make a scissors action for cutting things. The blades have a respective stop rod to limit the turning angle of the actuating bars. Because the turning angle of the actuating bars is limited within a narrow range by the stop rods on the blades, this structure of shears is suitable for cutting twigs and very small branches only. Another drawback of this structure of shears is that the twig or small branch tends to escape from the cutting edge during the cutting operation because the acting side of the anvil is a straight, smooth surface. Furthermore, when cutting an overhead branch, the user must use much effort to hold the shears in the cutting position.

SUMMARY OF THE INVENTION

The present invention has been accomplished to provide a shears which eliminates the aforesaid drawbacks. According to one aspect of the present invention, the first blade comprises two projecting portions at one end and a smoothly curved side notch defined between the projecting portions, second blade comprises a neck portion at one end and a smoothly curved locating head extended from said neck portion, wherein the smoothly curved locating head is inserted into the curved side notch and turned within it to limit the turning angle of the first and second blades. Therefore, the turning angle of the actuating bars can be extended as wide as 96×.

According to another aspect of the present invention, the anvil on the second blade has a plurality of anti-skid teeth acted against the cutting edge of the first blade, therefore the branch or twig does not escape out of the cutting position during the cutting operation.

According to still another aspect of the present invention, the second blade has a curved stop rod protruded over the front end of the anvil for stopping the branch or twig in place. When cutting an overhead branch, the curved stop rod can be hung on the branch so that the branch can be cut off by the cutting edge of the first blade with less effort.

According to still another aspect of the present invention, the cutting edge of the first blade is made of smoothly curved shape, and the shape of the acting side of the anvil of the second blade fits the cutting edge of the first blade.

DETAILED DESCRIPTION OF THE PREFERRED EMBODIMENT

Figure 1:
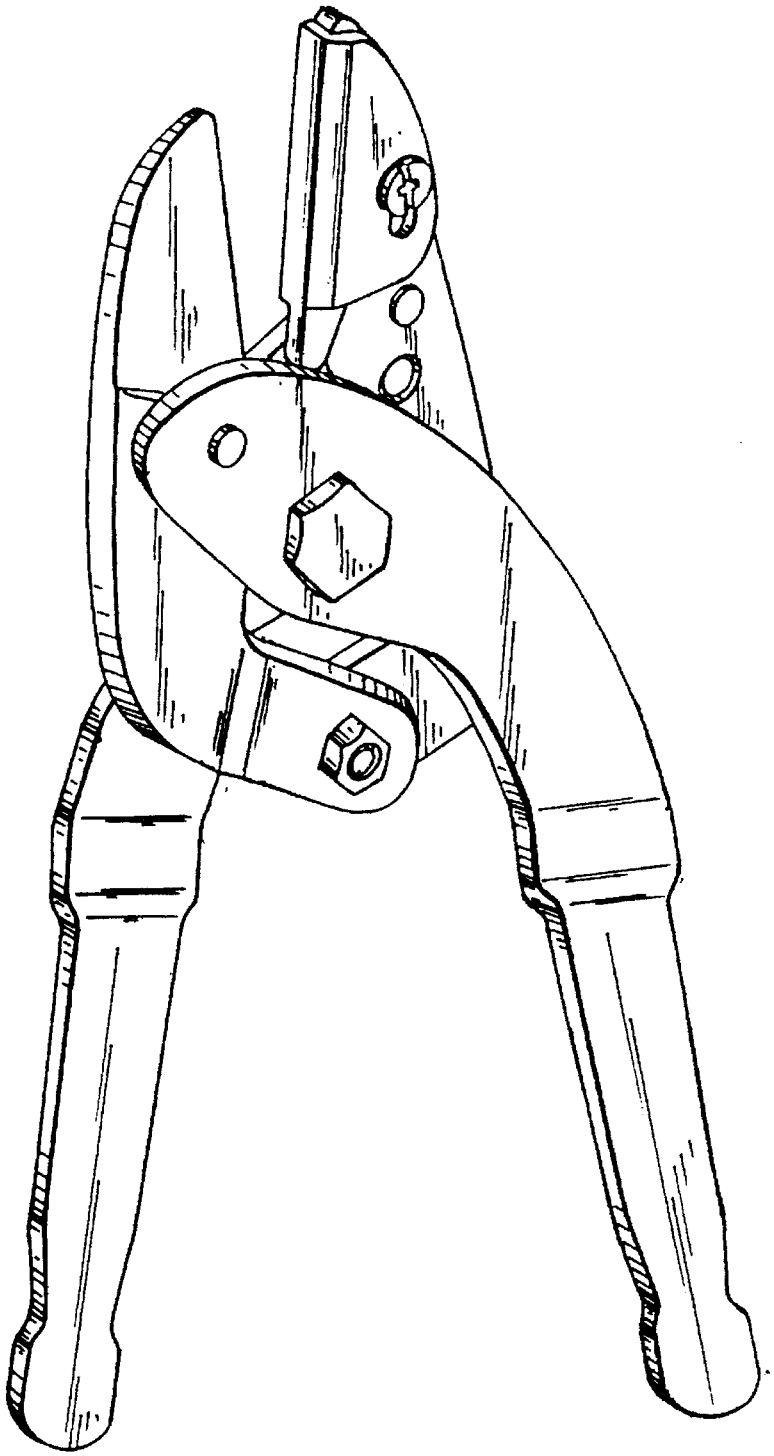
Fig. 1 PRIOR ART
FIG. 1 is an elevational view of a shears according to the prior art.
Figure 2:
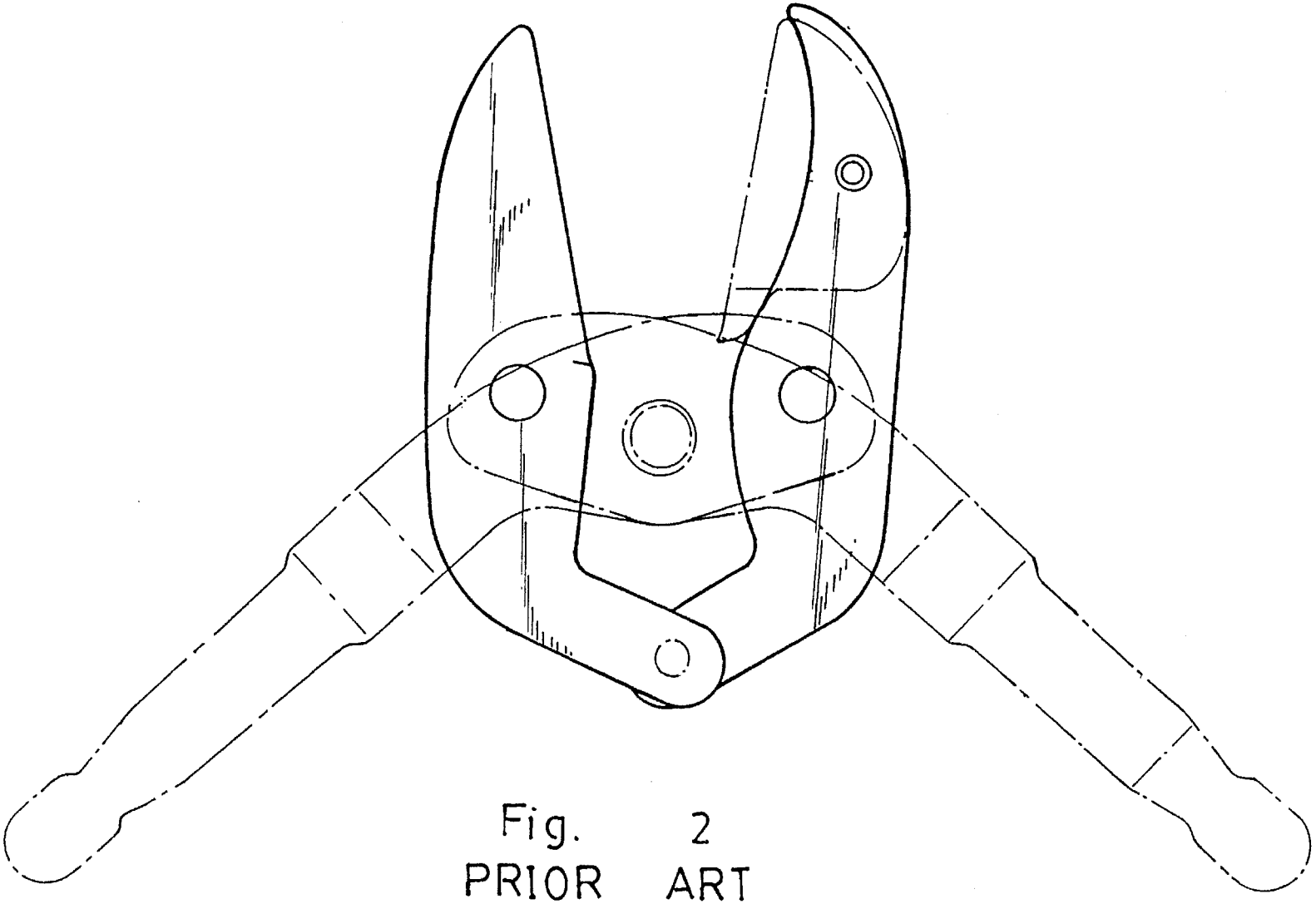
Fig. 2 PRIOR ART
FIG. 2 is a schematic drawing showing the shears of FIG. 1 opened.
Figure 3:
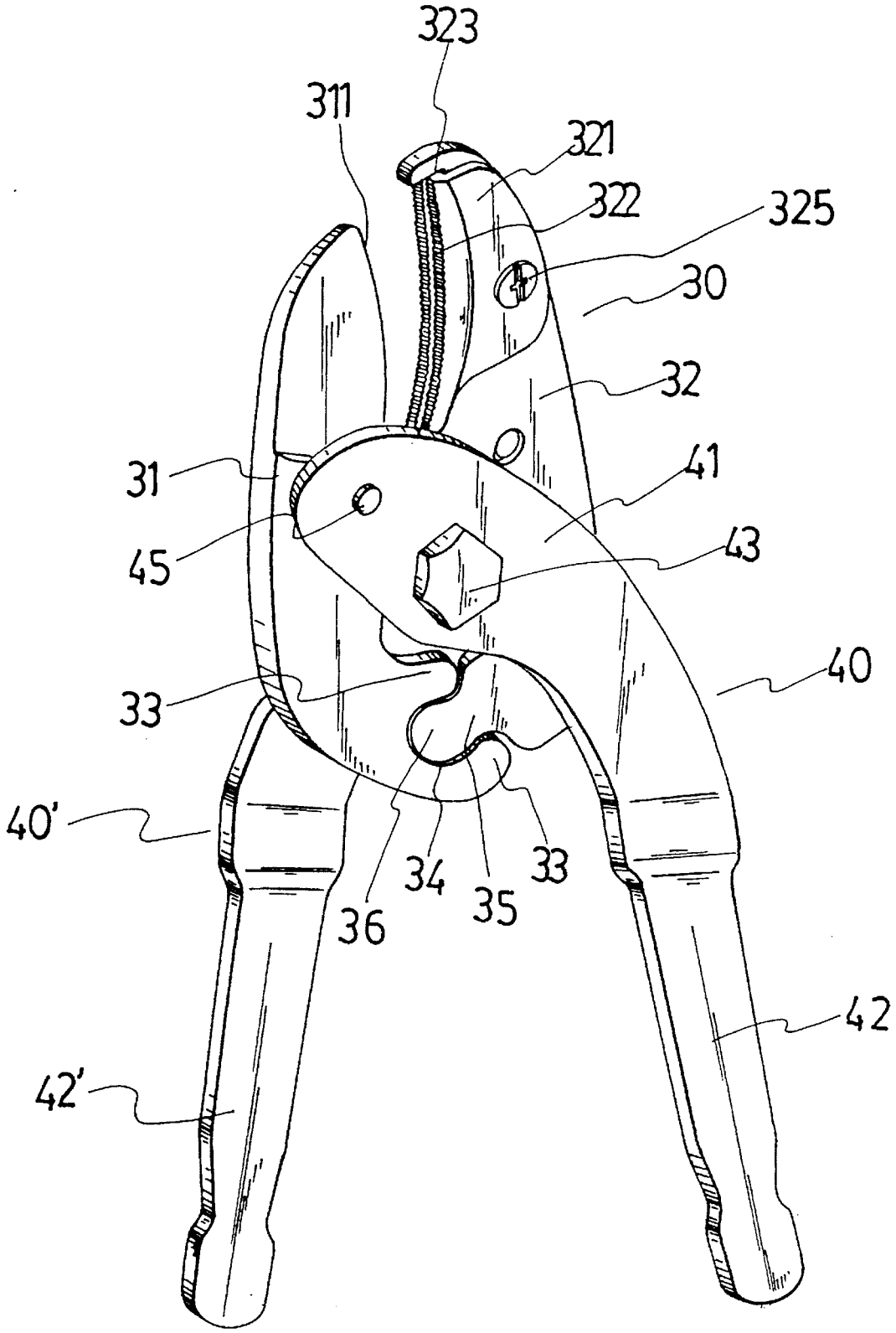
FIG. 3 is an elevational view of a shears according to the present invention.
Figure 4:
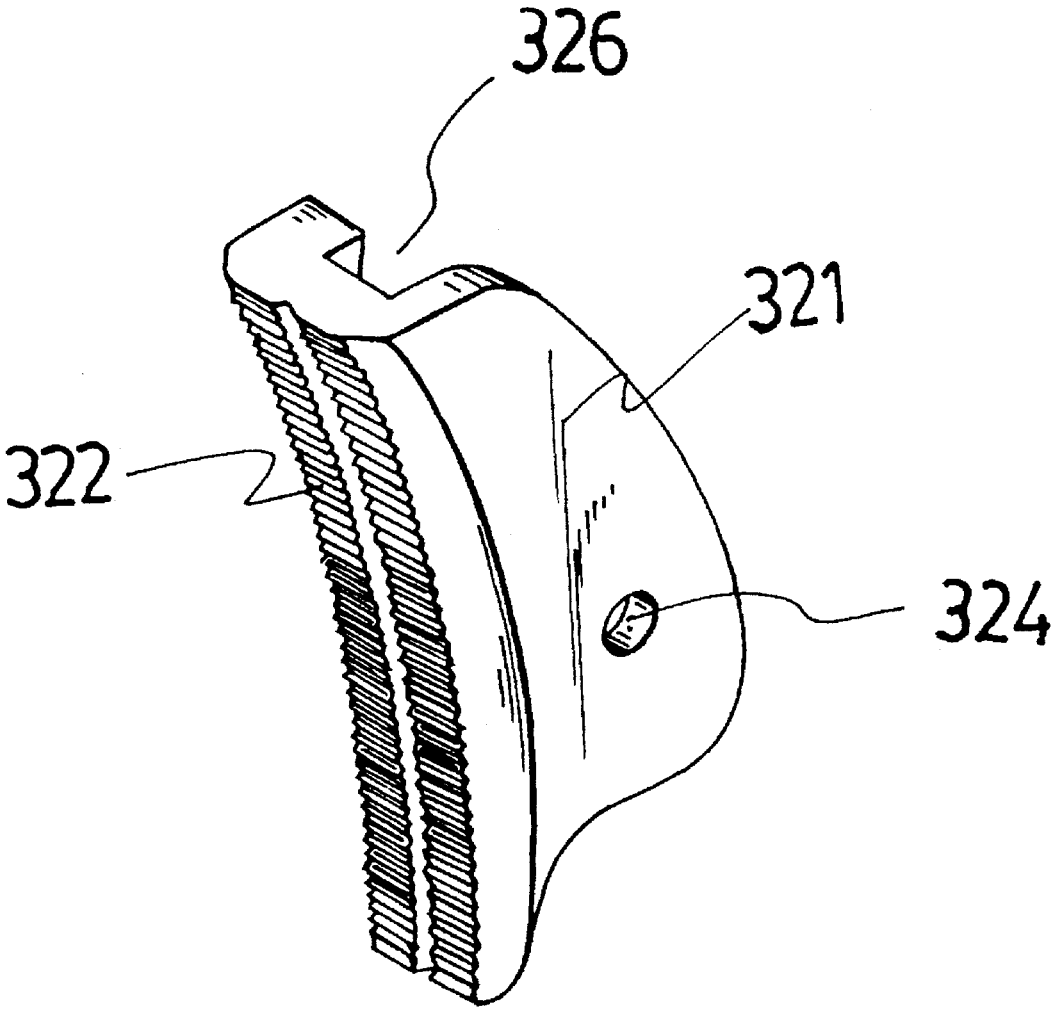
FIG. 4 is an elevational view of an anvil according to the present invention.
Figure 5A:
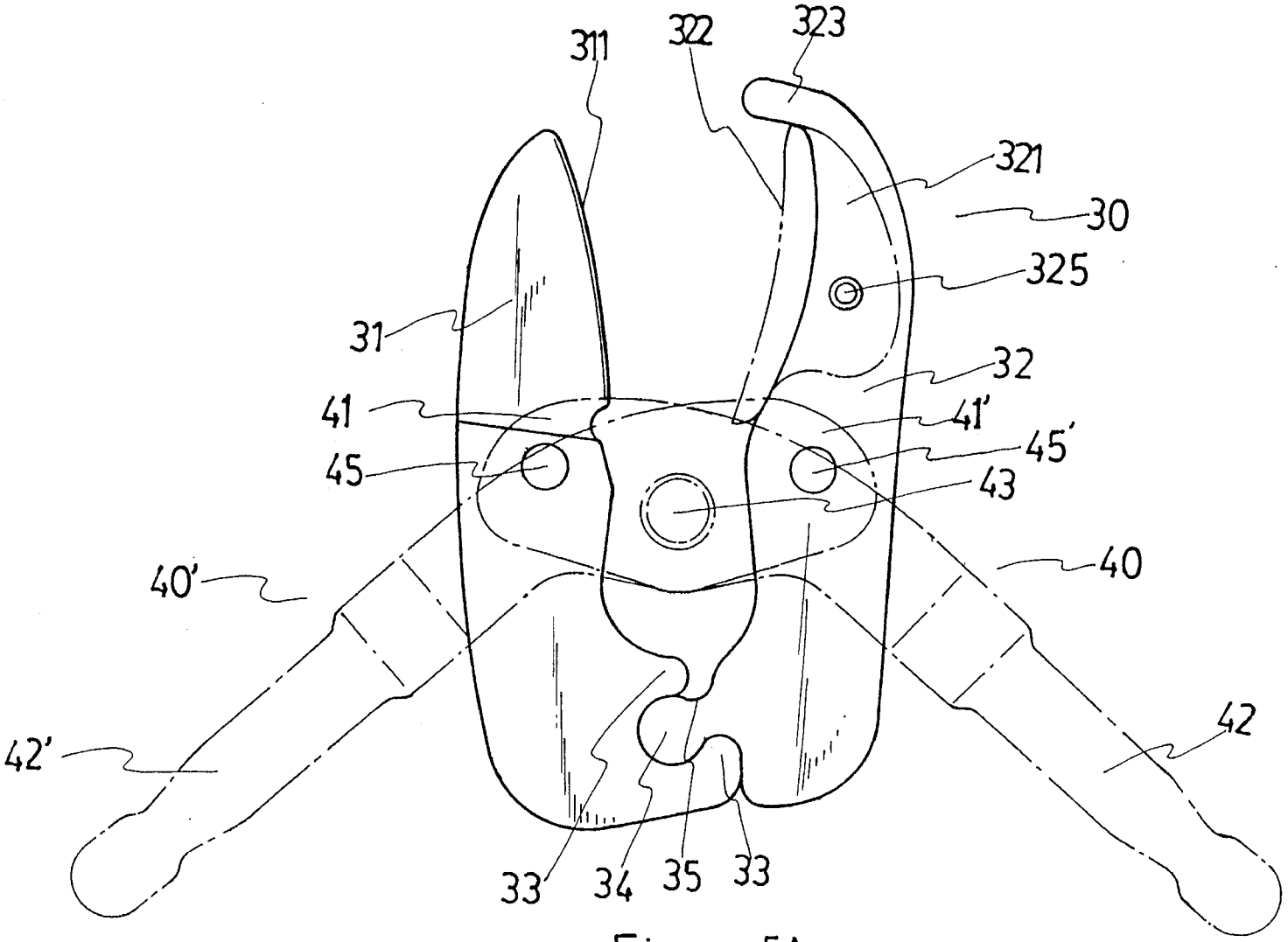
FIG. 5A is a schematic drawing showing the shears of FIG. 3 opened.
Figure 5B:
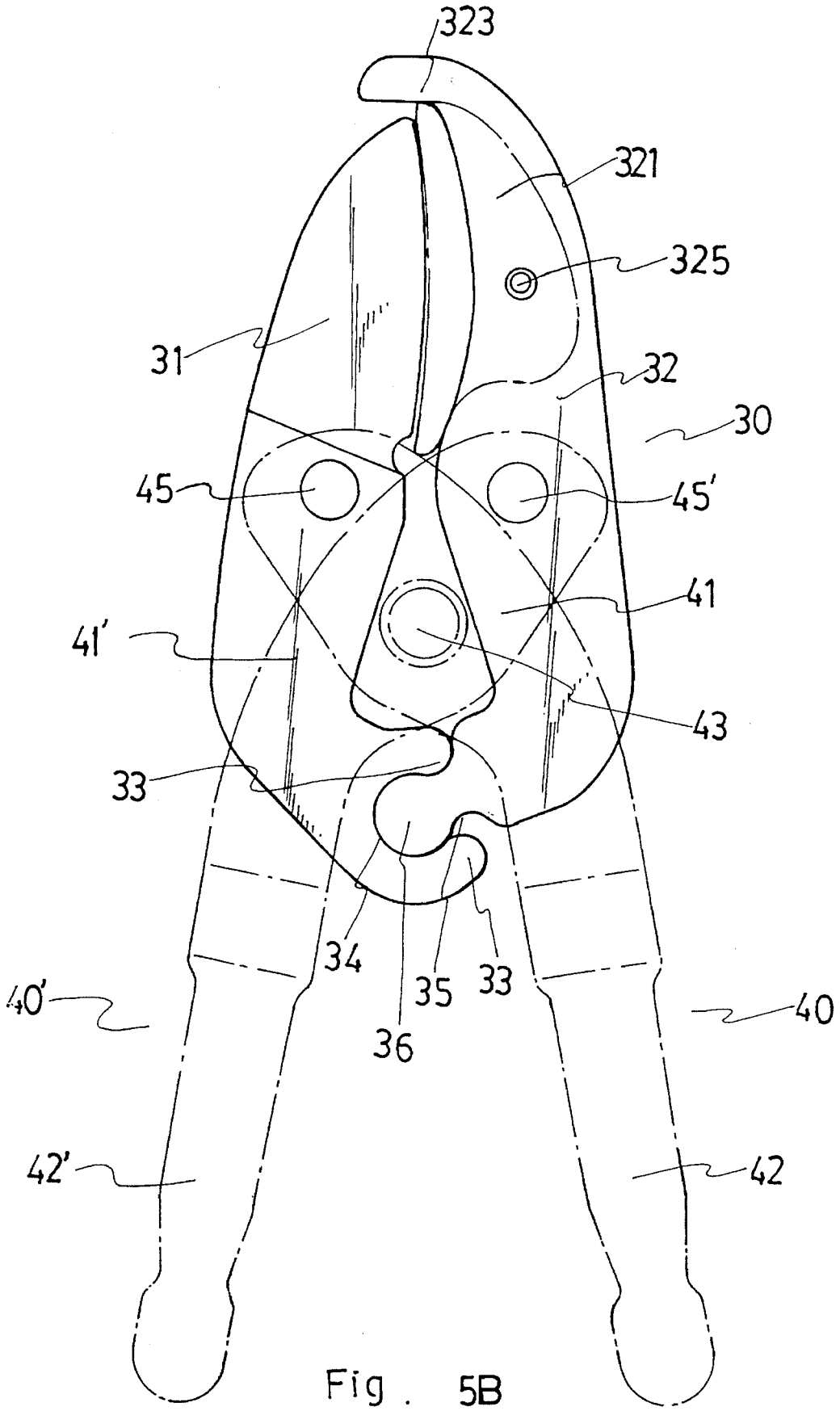
FIG. 5B is a schematic drawing showing the shears of FIG. 3 closed.

Referring to FIGS. 3, 4, 5A, and 5B, a shears in accordance with the preferred embodiment of the present invention is generally comprised of a cutting unit 30, and two actuating bars 40 and 40'. The actuating bars 40 and 40' each comprises a coupling portion 41 or 41' at one end and a handgrip portion 42 or 42' at an opposite end. The cutting unit 30 is comprised of a first blade 31 and a second blade 32. The first blade 31 comprises two projecting portions 33 at the rear end thereof, a smoothly curved side notch 34 defined between the projecting portions 33, and a smoothly curved cutting edge 311 at the front end thereof along one side. The second blade 32 comprises a neck portion 35 at the rear end thereof, a smoothly curved locating head 36 extended from the neck portion 35, and an anvil 321 at the front end thereof along one side facing the smoothly curved cutting edge 311 of the first blade 31. The shape of the anvil 321 fits the smoothly curved cutting edge 311 of the first blade 31. The smoothly curved locating head 36 is inserted into the curved side notch 34 and turned within it. Therefore, the projecting portions 33 limit the turning angle of the second blade 32 relative to the first blade 31. The anvil 321 comprises a longitudinal mounting groove 326 at the back side, which receives the second blade 32, a plurality of anti-skid teeth 322 at the front side corresponding to the smoothly curved cutting edge 311 of the first blade 31, a mounting hole 324 transversely intersecting the longitudinal mounting groove 326 and connected to a hole (not shown) on the second blade 32 by a fastening element, for example, a screw 325. The front end of the second blade 32 terminates in a curved stop rod 323 protruded over the front end of the anvil 321 for protection. The front end of the coupling portion 41 of the first actuating bar 40 is pivoted to the front side of the first blade 31 by a pivot 45. The front end of the coupling portion 41' of the second actuating bar 40 is pivoted to the back side of the second blade 32 by a pivot 45'. Furthermore, the middle part of the coupling portion 41 or the first actuating bar 40 is pivoted to the middle part of the coupling portion 41' of the second actuating bar 40' by a pivot 43.

When the actuating bar 40 and 40' are turned outwards relative to each other, the smoothly curved cutting edge 311 and the anvil 321 are moved apart from each other (see FIG. 5A), and therefore the twig or branch to be cut can be inserted in between the smoothly curved cutting edge 311 and the anvil 321. When the actuating bars 40 and 40' are turned inwards toward each other, the smoothly curved cutting edge 311 is forced toward the anvil 321 to cut off the twig or branch. Furthermore, when to cut an overhead branch, the curved stop rod 323 can be hung on the branch so that the branch can be cut with less effort.

Furthermore, the turning angle of the blades 31 and 32 is confined by the matching of the locating head 36 with the projecting portions 33. When the actuating bars 40 and 40' are turned inwards or outwards, the locating head 36 is turned within the smoothly curved side notch 34 to guide the scissors action of the cutting unit 32. The maximum open angle of the cutting unit 30 can be as wide as 96×. Because the turning angle of the blades 31 and 32 is confined by the matching of the locating head 36 with the projecting portions 33, the blades 31 and 32 will not be moved out of place when the cutting unit 30 is opened to the maximum open angle.

I claim:

1. A shears comprising a cutting unit consisting of a first blade and a second blade, and two pivoted actuating bars turned relative to each other to drive said first and second blades, causing them to make a scissors action for cutting things, wherein:

said actuating bars each comprises a coupling portion at one end and a handgrip portion at an opposite end, the coupling portions of said actuating bars having a respective middle part pivoted to each other by a pivot and a respective front end pivoted to one blade of said cutting unit;

said first blade comprises two projecting portions at one end, a smoothly curved side notch defined between said projecting portions, and a smoothly curved cutting edge at an opposite end along one side;

said second blade comprises a neck portion at one end, a smoothly curved locating head extended from said neck portion, and an anvil at an opposite end facing said smoothly curved cutting edge of said first blade, said smoothly curved locating head being inserted into said curved side notch and turnable therein it to limit the turning angle of said first and second blades, said anvil having a plurality of anti-skid teeth for action against said smoothly curved cutting edge.

* * * * *